US008925124B2

(12) United States Patent
Littlehorn, Sr.

(10) Patent No.: US 8,925,124 B2
(45) Date of Patent: Jan. 6, 2015

(54) PORTABLE HAND WASHING STATION

(76) Inventor: Michael J. Littlehorn, Sr., Golden, CO (US)

( * ) Notice: Subject to any disclaimer, the term of this patent is extended or adjusted under 35 U.S.C. 154(b) by 482 days.

(21) Appl. No.: 13/209,666

(22) Filed: Aug. 15, 2011

(65) Prior Publication Data

US 2013/0042404 A1 Feb. 21, 2013

(51) Int. Cl.
*A47K 1/00* (2006.01)
*A47K 1/02* (2006.01)

(52) U.S. Cl.
CPC ..... *A47K 1/02* (2013.01)
USPC ..... 4/626; 4/628; 4/630; 4/654

(58) Field of Classification Search
USPC ..... 4/619, 625–627, 630, 628; 222/501, 222/518, 559, 181.1–181.3, 511, 544
See application file for complete search history.

(56) References Cited

U.S. PATENT DOCUMENTS 1,751,294 A * 3/1930 Spital ..... 4/626
4,338,884 A * 7/1982 Atchley et al. ..... 119/72.5
4,406,253 A * 9/1983 Atchley et al. ..... 119/72.5
5,301,376 A * 4/1994 Herbert ..... 4/626
5,522,411 A * 6/1996 Johnson ..... 134/95.2
5,715,547 A * 2/1998 Becker et al. ..... 4/619
7,802,327 B1 * 9/2010 Moceri et al. ..... 4/625
7,886,936 B2 * 2/2011 Helline ..... 222/185.1

* cited by examiner

*Primary Examiner* — Huyen Le
*Assistant Examiner* — Janie Christiansen
(74) *Attorney, Agent, or Firm* — Roger A. Jackson

(57) ABSTRACT

A portable hand washing station is provided. The station has a durable carrying case which defines an interior hand washing compartment. The front wall is adapted to include a door to permit hand access into the interior of the hand washing compartment. A lid is connected to the case so that the lid is capable of extending in an upright vertical position. A shelf is connected to the interior surface of the lid. The shelf has a pair of spaced apart valve openings. A pair of liquid dispensing reservoirs is supported on the shelf. Each of the reservoirs includes a top wall with a mouth opening, a bottom wall with a drain opening, and a touch operated flow valve connected to the bottom wall in liquid communication to the bottom wall. The flow valves are adapted to extend in axial alignment a one of the valve openings so that a cleaning or rinsing solution is dispensed into the compartment when the flow valves are deflected by hand.

18 Claims, 4 Drawing Sheets

PORTABLE HAND WASHING STATION

CROSS REFERENCE TO RELATED APPLICATIONS

None.

STATEMENT OF FEDERALLY SPONSORED RESEARCH

Not applicable.

BACKGROUND OF THE INVENTION

1. Field of the Invention

The present invention relates to hand washing equipment. In particular, it relates to a portable hand washing station.

2. Description of the Related Art

Portable hand washing equipment is desirable for use in recreational, emergency, and temporary service applications. Such equipment is well known in the art, and typically includes the essential component parts of a lavatory having a water supply and spigot to control the flow of water from a liquid flow tube.

Once such device is disclosed, in U.S. Pat. No. 1,358,937, issued to Curliss. This device is a portable lavatory having a water receptacle, with a tiller cap top opening, and a swing down front tray. The receptacle includes a lower discharge opening with a water spigot for discharging water into the tray. The receptacle includes an air vent and an accessory spring clamp, for holding a towel. The tray is pivotally and slidably mounted on the receptacle, and is adapted to operate so that the air vent is closed when the tray is fastened to the receptacle in an upright vertical closed position.

Improvements to the portable lavatory concept include the addition of a hand drying apparatus. For example, U.S. Pat. No. 5,522,411, to Johnson, discloses a portable hand washing and drying station with a front hand-receiving-opening in communication with a central hand washing compartment. Above the hand washing compartment is an upper compartment with a cleansing liquid reservoir, a spigot-controlled flow tube for delivering cleansing liquid from the reservoir to the hand washing compartment, and an electrically powered fan for air drying the hands to be washed. The reservoir and fan are supported on a shelf which slides into and out of the housing. Situated below the hand compartment is a removable waste liquid receptacle for temporarily storing used the cleansing liquid.

Another such device is disclosed in U.S. Pat. No. 7,802,327, to Moceri et al. There, a portable and compact hand washing station is disclosed for use in training children. The station includes a main housing with a basin, a drain hole disposed in the basin, and a back splash panel projecting behind and above the basin. Support legs support the main housing. A reservoir is disposed in the back splash panel, and a spigot is in fluid communication with the reservoir. The spigot extends over and empties into the basin. When one positions one of the support legs inside a bathtub or shower, fluid entering the basin by gravity, from the reservoir and through the open-able spigot, exits via the drain hole, and empties into the bath tub or shower.

While the foregoing examples offer some utility, and together typify the existence of the background art as it relates to the field of the present invention, the prior art devices necessitate the use of either large water containing reservoirs and/or a plumbing connection. Moreover, such devices are difficult to clean, extremely heavy and not easily transported, and are easily contaminated in use from one individual to another. Moreover, they do not provide for separate cleaning and rinsing reservoirs which are interchangeable for use in a wide variety of applications, such as for the removal of grease and grime and/or for the purpose of disinfection in the food service, emergency services, or recreational industries. Thus, what is needed is a portable hand washing station which is self contained, easy to clean, reduces cross-contamination, but which is also easy to transport and provides low-volume and interchangeable cleaning and rinsing reservoirs for use in a wide variety of applications. The present invention satisfies these needs.

BRIEF SUMMARY OF THE INVENTION

It is therefore an object of the present invention to provide a portable hand washing station which is self contained, easy to clean, and reduces cross-contamination.

It is another object of the present invention to provide a portable hand washing station which is self contained, easy to transport, and permits the efficient low-water-volume use of cleaning and rinsing solutions in a wide variety of applications.

To overcome problems associated with the prior art, and in accordance with the purpose(s) of the present invention, briefly a portable hand washing station is provided. The portable hand washing station is contained in a durable carrying case. The case has a pair of spaced apart side walls connecting a bottom wall, back wall, and front wall. The case walls define an interior hand washing compartment. The front wall is adapted to include a door which is capable of opening to permit hand access into the interior of the hand washing compartment. A lid is adapted to be connected to the case in a position which is adjacent to the back wall so that the lid is capable of extending in an upright vertical position. A shelf is connected to the interior surface of the lid. The shelf has a pair of spaced apart valve openings. A pair of liquid dispensing reservoirs is supported on the shelf. Each of the reservoirs includes a top wall with a mouth opening, a bottom wall with a drain opening, and a touch operated flow valve connected to the bottom wall in liquid communication with the drain opening. The flow valves are adapted to extend in axial alignment with a one of the valve openings so that a cleaning or rinsing solution is capable of being dispensed into the compartment when the flow valves are deflected by hand.

Additional advantages of the present invention will be set forth in the description that follows, and in part will be obvious from that description or can be learned or appreciated from practice of the invention. Moreover, the advantages of the invention can be realized and obtained by the invention as more particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the present invention and, together with the description, explain the principles of the invention through illustration to persons of skill in the art.

DETAILED DESCRIPTION OF THE DRAWINGS

Figure 1:
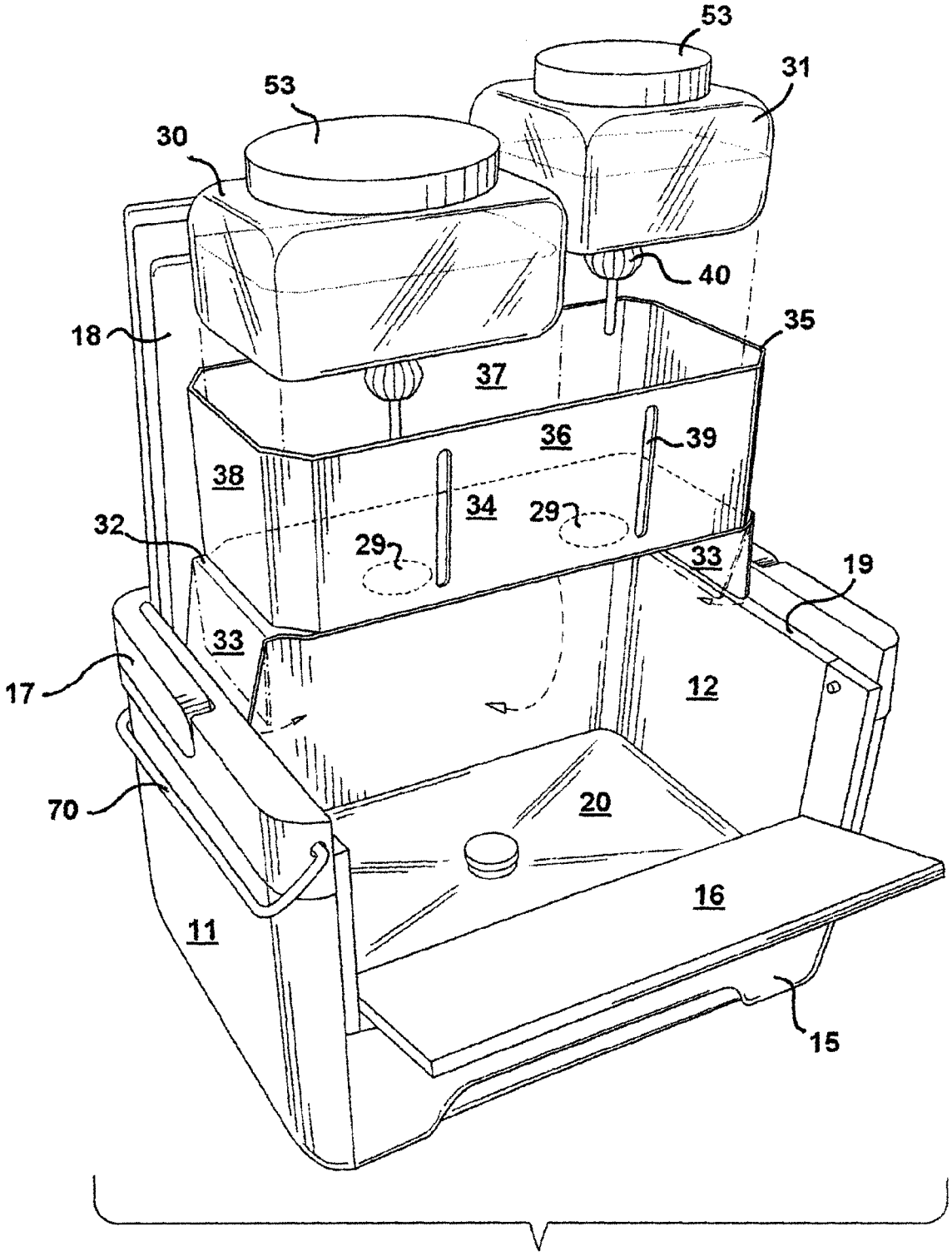
FIG. 1 is a perspective view of a preferred embodiment of the hand washing station in accordance with the present invention.
Figure 2:
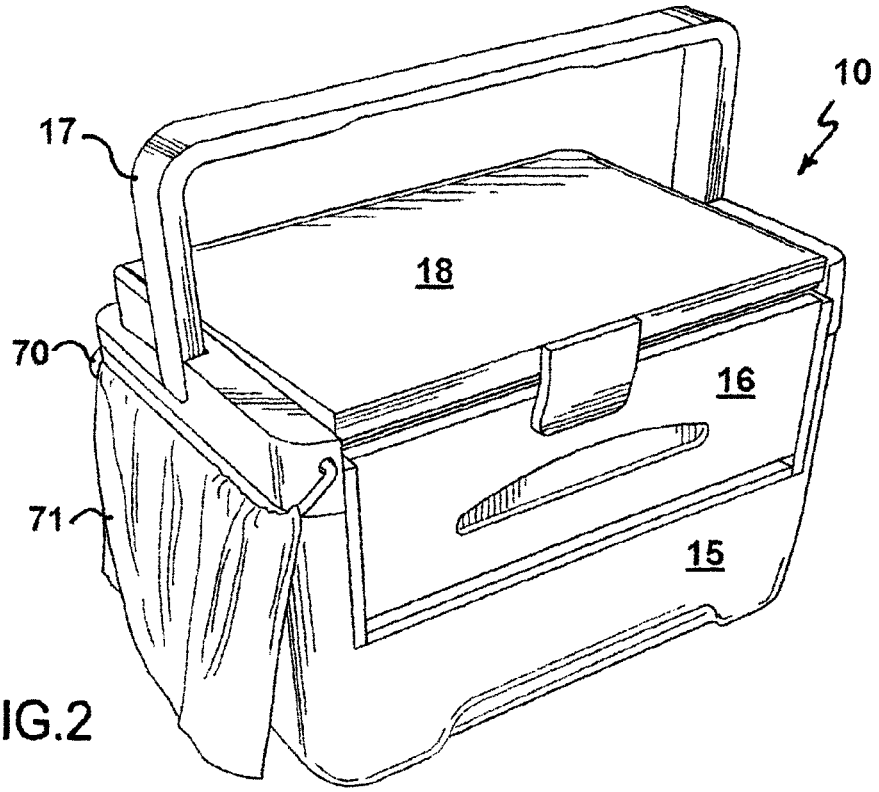
FIG. 2 is a perspective view of the preferred embodiment showing the lid in a closed transportable position, the handle in an upright carrying position, and towel bar holding the towel securely against a sidewall of the carrying case.
Figure 3:
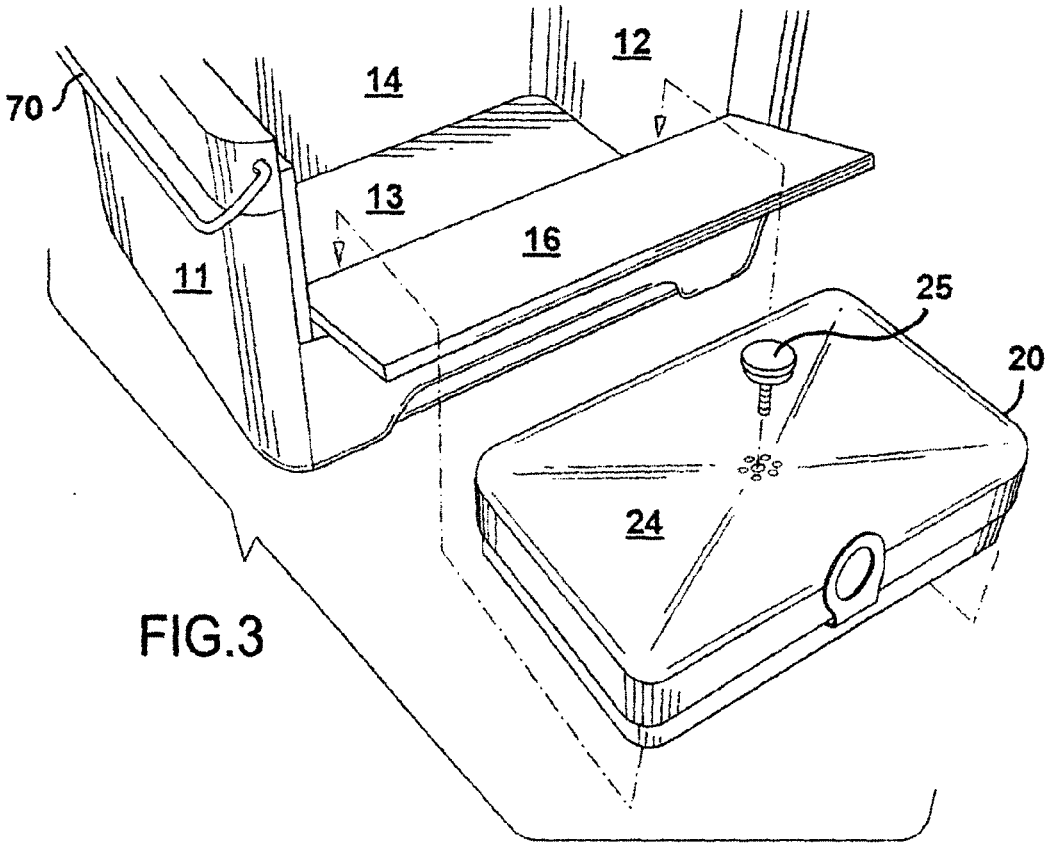
FIG. 3 is a perspective view of a portion of the front of the preferred embodiment showing the front door in an open position, for hand access into the interior of the washing compartment, and the removable feature of the waste liquid carboy from the interior of the hand washing compartment.

Unless specifically defined herein, all scientific, technical, and ordinary terms as used herein, have the same ordinary meaning as would be commonly understood by one of ordinary skill in the art to which this invention belongs.

Although, many methods and materials which are similar or equivalent to those described herein, can be used in the practice or testing of the present invention, the preferred methods and materials are now described. Reference will now be made in detail, to the presently preferred embodiments of the invention, including the examples of which are illustrated in the accompanying drawings. In the drawings, like numerals will be used in order to represent the like features of the invention.

The present invention provides a portable hand washing station for use in a wide variety of applications. The hand washing station is constructed with a durable outer carrying case 10. The carrying case 10 is preferably a double wall insulated construction formed of a molded plastic. For example, the case is even more desirably constructed of a durable marine grade polyethylene so that the interior and exterior surfaces are easy to wipe clean, after each use. In the presently preferred embodiment, the case has an exterior dimension or 33×24.13×22.53 centimeters (L×W×H), with an interior volume of approximately 8 liters. In this configuration, the case is molded in a rectangular box like shape for ease in positioning on a table, and for stacking and storage. The case includes a pair of spaced apart side walls 11, 12 connecting a bottom wall 13, back wall 14, and a front wall 15. The walls are preferably molded so that the case is a one-piece water-tight shell construction. These walls define an interior hand washing compartment.

The front of the carrying case 10 is adapted to include a front door 16. The door 16 is of sufficient size and shape so that it is capable of opening to allow hand access into the interior of the hand washing compartment. As shown in the drawing figures, and in the presently preferred embodiment, the door 16 is pivotally attached to the inner surface of the side walls 11, 12 so that it opens on a horizontal axis. With this configuration, the front wall 15 of the case is the truncated lower portion of the front of the case. The door 16, of the upper portion, is preferably constructed from a 1 centimeter thick sheet of durable super high density polyethylene, similar to a cutting board, which is pivotally attached to the interior of the side walls 11, 12 of the case. In this manner, the lower portion of the front wall 15 remains rigidly formed, as an integral construction, with the side walls 11, 12 and bottom wall 13, of the case, and is configured so that it is slightly taller than the vertical depth of the waste containing carboy 20. The lower portion thereby creates an inner chamber for containing and securing the waste containing carboy 20 in the bottom of the case 10, but also extends sufficiently above the carboy 20 to act as a water containing basin, in use, so that water does not flow out of the compartment. Finally, the case preferably includes an integrated swing-up handle 17. The handle 17 is attached to the case 10 at a location which is adjacent to the side walls 11, 12, for ease in carrying.

A lid 18 is provided for covering the interior compartment of the case. The lid 18 may either be pivotally attached to the case 10 or designed as a separate lift-off top, but, in any event, the lid 18 is necessarily designed so that it is capable of vertical support, adjacent to the back wall 14 of the case 10, in an upright open position for accessing the interior of the compartment, supporting the reservoirs 30, 31, and alternately covering the compartment in order to secure the hand washing station for travel and storage.

It is preferably to construct the case and lid 18 as an assembly so that the lid 18 is in pivotal connection with an interior surface of the side walls 11, 12. For this embodiment, either the lid 18, or the side walls 11, 12 typically will include a combination of corresponding pivot pins and/or pivot pin receiving holes, aligned so that they are adjacent to the back wall 14. Again, an important feature, of the present invention, as it relates to the lid 18, is that the lid is simply adapted to be capable of support, on the case 10, in an upright vertical position. The lid 18 is also constructed so that it has a rigid interior surface for either attaching a shelf 32 or for including a shelf 32 as a component of the lid 18 in an integral molded construction.

A shelf 32 is attached to the interior surface of the lid 18. The shelf 32 desirably includes a pair of spaced apart clear holes 29 for receiving the touch valves 40. The shelf 32 is thereby dimensioned so that it is capable of fitting into the compartment interior when the lid 18 is pivoted downwardly in a compartment enclosing, or covering, position. The shelf 32 is attached to the interior surface of the lid 18, in any manner which is well known in the art, including molding the lid 18 and shelf 32 as a one-piece assembly or attaching the lid 18 with adhesives or fasteners.

As shown in the drawing figures, and in accordance with the presently preferred embodiment, the lid 18 is pivotally attached to the side walls 11, 12 of the case 10. In addition, a horizontal lip 19 is formed in an upper interior surface of each of the sidewalls 11, 12, and the shelf 32 further includes a pair of transverse bends or folds. The folds, or bends, in the shelf sheet stock, define a pair of oppositely aligned flat-spring end members 33. The spring end members 33 are adapted to project downwardly at a first extended angle so that the ends 33 are capable of engaging the lip 19 formations when the lid 18 is pivoted to an open vertical position. In this manner, the spring end members 33 act as support legs which serve to support the reservoirs 30, 31, the shelf 32, and the lid 18 in an upright open vertical position. In use, the flat-spring end members 33 are compressible, to a second angle, so that the spring members 33 are capable of releasing support legged engagement from the lip 19 formations. Release of the end members 33 is easily performed with the fingers, of the hand, by slightly lifting the shelf, with the palm of the hand, and pinching the ends inwardly, with the fingers, in order to permit the lid 18 to pivot downwardly into an enclosing position, for transport and storage of the hand washing station.

In an even more preferred embodiment of the present invention, and as illustrated in the drawing figures, the interior of the hand washing compartment further includes a reservoir rack 35. The reservoir rack 35 may be constructed of a thin sheet of steel, but is desirably constructed as a single molded plastic body. The rack 35 has at least a front 36, back 37, and side walls 38. The back wall 37 is connected to the interior surface of the lid 18 so that the rack 35 may be secured in relation to the shelf 32, and is thereby capable of preventing movement of the reservoirs 30, 31, when the hand washing station is subjected to a lateral force, when the lid 18 is positioned in either an open or a closed position. The front wall 36 of the rack 35 may also, but need not, include a pair of spaced apart clear slots 39 which are positioned so that the slots 39 permit viewing of a graduated liquid contents contained in the reservoirs 30, 31. Finally, the rack 35 may include the bottom wall, as shown in the drawing figures, so that the rack 35 is a single molded box-like plastic body with an open top, for inserting and removing the reservoirs 30, 31. Here, the bottom wall 34 also includes another pair of spaced apart clear holes, positioned in axial alignment with the valve opening clear holes 33 in the shelf 32, for receiving the touch valves 40.

A pair of liquid dispensing reservoirs 30, 31 is supported on the shelf 32. One of the reservoirs 30 is used for containing the cleaning solution and the other 31 for containing the rinsing solution. In the preferred embodiment the cleaning solution is a aqueous soap solution and the rinsing solution is water. The reservoirs 30, 31 are preferably configured as a molded bottle shaped body which is formed from a transparent Nalgene™, polypropylene, polyethylene, or polycarbonate material(s), in a manner which is very similar to those which one would ordinarily associate as offered for sale by chemical laboratory supply companies for use by chemical laboratory professionals. Wide-mouth bottles formed of these materials are particularly suitable, for use with the present invention, because they are easy to clean and are even amenable to high temperature, pressure, or chemical sanitization and/or sterilization depending on the intended use, as in circumstances where the desired use represents a potential for bio-hazardous contamination.

As above, the reservoirs 30, 31 are preferably formed in a wide-mouth screw capped bottle configuration with a central drain opening 50 in the bottom wall. As shown in the drawing figures, the bottom wall 51 of the reservoirs 30, 31 preferably includes an externally threaded annular flange 52 portion, configured about the drain opening 51, for threadably connection of the touch operated flow valves 40. The threaded connection permits upward and downward dislocation of the flow valves 40 which permits the use and operation of the cup-shaped shut-off valve 60, as more fully described below.

The wide mouth opening, in the top wall, also includes an externally threaded flange portion for attaching a screw cap 53. In use, the screw cap 53 is easily loosened in order to vent the liquid contents of the reservoirs 30, 31 so that the liquid contents are capable of discharge through the drain openings 50. The annular flange 52 portions, in the bottom walls 50 of the reservoirs 30, 31, are necessarily formed so that they are capable of extending downwardly in axial alignment with the valve openings 29, in the shelf 32 and/or reservoir rack 35. Each of the reservoirs 30, 31 includes the touch operated flow valve 40 in threaded connected to the bottom wall to permit liquid communication with the drain opening 50. Finally, the first reservoir 30 and the second reservoir 31 are desirably scaled to contain different volumetric amounts. In particular, it is preferred that the rinsing reservoir 31 is designed to hold twice the volume of the cleaning reservoir 30.

Figure 6:
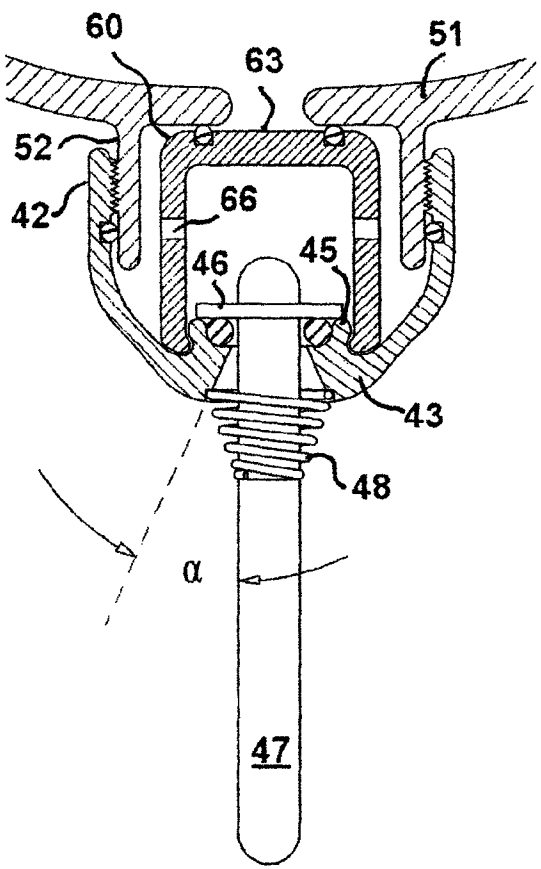
FIG. 6 is a side sectional view of yet another embodiment of the present invention where the touch valve assembly includes a spring member disposed to press lit in an annular configuration about the lever arm so that the spring member is in compressive communication with an outer retaining lip formed at a distal portion of the inwardly tapering cylindrical opening.
Figure 5:
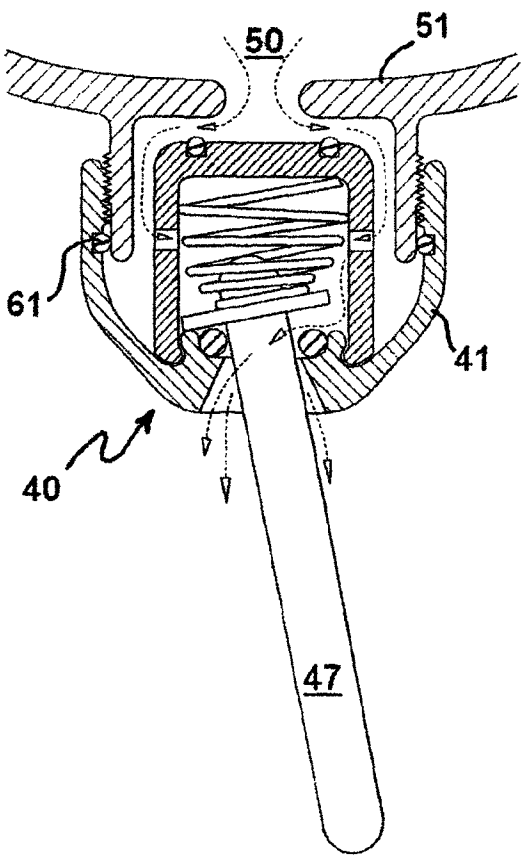
FIG. 5 is a side sectional view further illustrating the embodiment of FIG. 4 where the touch valve housing is rotated, counter-clockwise, to release the to solid portion of the cup shaped shut-off valve from the drain opening to thereby discharge a cleaning or rinsing solution through the tapered opening, and along the lever arm into the hand washing compartment.
Figure 4:
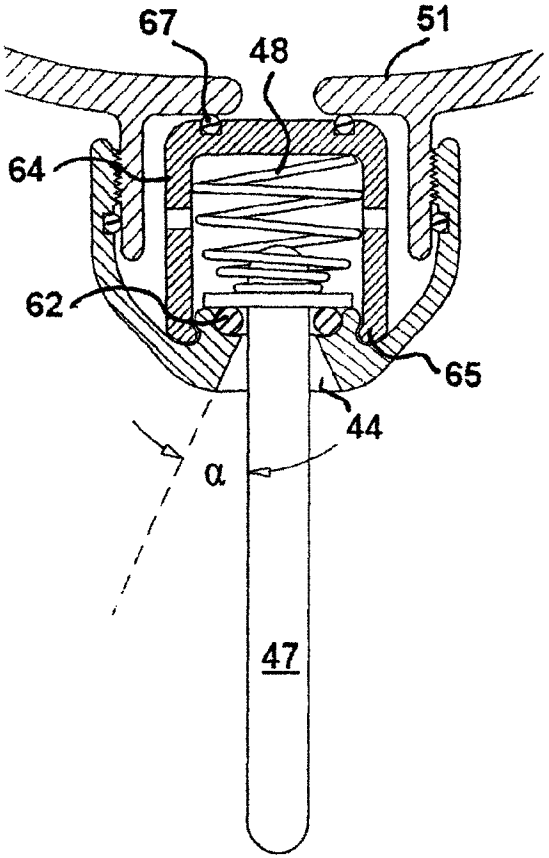
FIG. 4 is a side sectional view showing one embodiment of the touch valve assembly where the touch valve includes a spring member and shut-off valve. The drawing figure illustrates the deflection angle for discharging a cleaning or rinsing solution, and positioning of a spring member within the valve chamber so that it is disposed against the valve lever member to permit centering and pivotal movement of the valve lever head member, between a valve closed centered position and a valve open radially displaced position.

Referring now, in particular, to the embodiments shown in FIGS. 4-6, the touch operated flow valves 40 include an internally threaded valve housing 41 which, in turn, is threaded onto the externally threaded flange 52 portion of the bottom wall 34 of the reservoirs 30, 31. The valve housing 41 has a central chamber, a proximal end 42 adapted for connection to the drain opening 50, a distal end 43 formed with an inwardly tapering cylindrical opening 44, and an interior wall formed with an annular valve seat 45. The touch operated flow valve 40 has a valve lever member, centrally mounted in the chamber. The valve lever member is formed with an annular valve head member 46 and a valve lever arm 47. The valve head member 46 is adapted to water seal against the valve seat 45. The lever arm 47 is dimensioned to extend through the inwardly tapering opening 44, into the interior of the hand washing compartment, so that a flow of water is permitted to pass between the valve lever arm 47 and the inwardly tapering opening 44 while the distal end of the lever arm 47 is deflected by hand. The inwardly tapering opening 44 is preferably constructed with an inwardly sloping conical surface so that it opens fully with angular deflection (shown as a in drawing FIGS. 4 and 6) of less than 25 degrees. The proximal end 42 of the valve housing 41 includes a first O-ring 61, fitted between the interior threaded portion of the proximal end 42 of the valve housing and the external surface of the bottom wall flanged portion 52, in order to water-seal the valve housing in relation to the reservoir drain opening 50. A second O-ring 62 is disposed between the valve seat 45 formation and the valve head 46, of the lever member, to provide a water-seal between the valve head member 46 and the valve seat 45 when the lever arm 47 is positioned in a central position. A third O-ring 67 is fitted between the top surface 63 of the shut-off valve 60 and the bottom wall 51 of the reservoir.

As mentioned above, where the touch operated flow valves 40 are embodied to threadably connect to the flange portion 52 of the bottom wall 51, the touch valve 40 may, but need not, further include an internal inverted cup-shaped shut-off member 60 disposed annularly about the drain opening 50. The shut-off valve 60 is defined with a solid top surface 63, which biases against, and to seal, the drain opening 50, and a circumferential sidewall 64 with a distal annular flange 65. The circumferential side wall 64 includes a plurality of openings 66, such as holes or slots, for channeling the cleaning and rinsing solutions into the central chamber of the valve housing. The distal annular flange 65, or lip, shaped portion is adapted to snap-fit a complimentary formation in the inner wall of the central chamber so that shut-off valve 60 operates in open and closed cooperation with the valve housing when the valve housing is rotated in a counter clockwise and clockwise directions, respectively.

The shut-off valve 60 is adapted to cooperate with the valve housing to open and close open channel flow into the central chamber. When the touch valve 40 is rotated in a tightened, or clockwise, direction, the solid top surface 63, of the shut-off valve 60, biases against the drain opening 50 so that the liquid flow is stopped and contained in a closed channel condition. When the touch valve 40 is loosened, in a counter-clockwise direction, the sold top surface 63 of the shut-off valve 60 is disposed in a spaced relationship below the drain opening 50 so that an open channel condition permits liquid flow of solution into the central chamber, of the touch valve housing, an permit dispensing of the liquid for hand washing when the lever arm 47 is deflected by hand. Thus, by connecting the distal portion of the shut-off valve 60, about the annular valve seat 45, to the inner wall of the valve housing, and threading the valve housing onto the bottom wall 51 of the reservoir 30, 31, one may alternately rotate the valve housing to either engage or disengage the shut-off valve 60 from the drain opening 50. It follows that, in operation, rotation of the valve housing, in this manner, further permits one to meter the flow of the liquid contents, of the reservoirs, in proportion to the degree of rotation of the valve housing. This feature is particularly useful, in providing flexibility, in applications where one intends to use differing concentrations, or formulations, of cleaning solutions in relation a volume of rinsing solution.

Figure 7:
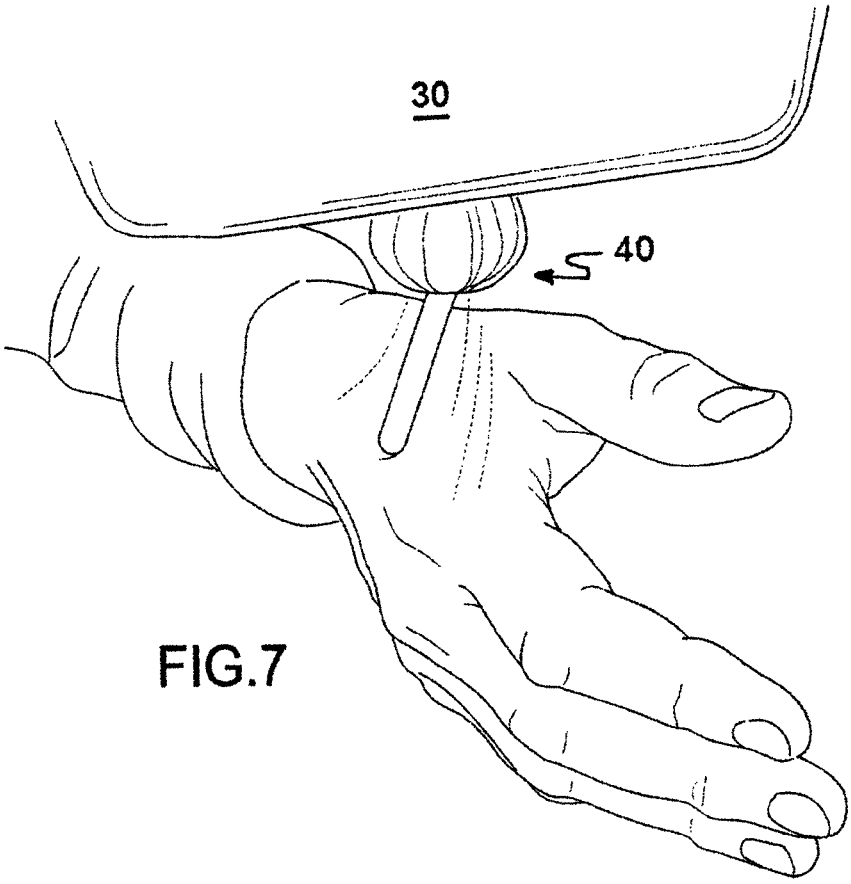
FIG. 7 is an anatomical representation showing operation of the touch valve by lateral deflection, with the hand.
Figure 8:
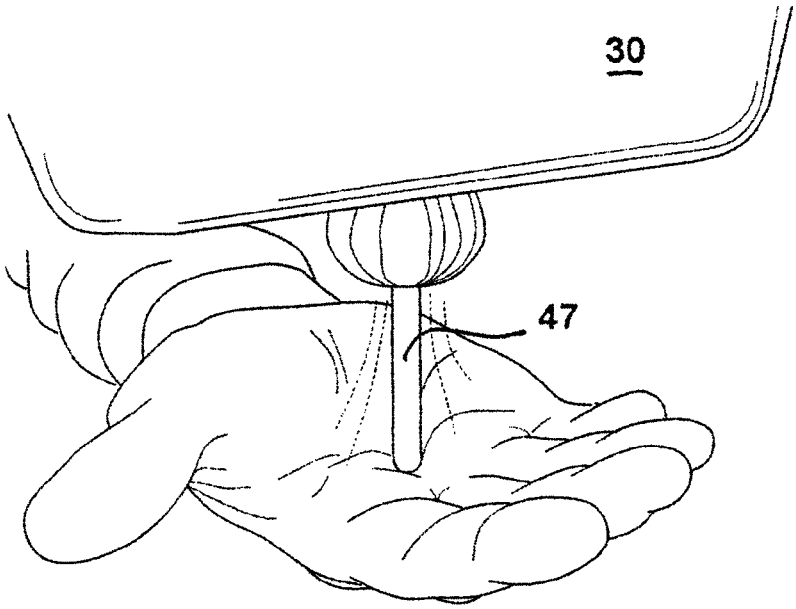
FIG. 8 is an anatomical representation showing operation of the touch valve by upward deflecting the touch valve, with the hand.

The shut-off valve member 60 includes a plurality of openings 66 in the sidewall 64 to permit the flow of liquid from the drain opening 50 of the reservoirs 30, 31, past the top solid surface 63 of the shut-off valve 60, through the openings 66 in the sidewall 64, and into the central chamber of the valve housing. The dashed line illustrations in FIG. 5 show this flow pattern in accordance with this embodiment. There, in FIG. 5, when the valve housing is rotated to a loosened position and the shut-off valve 60 is disposed downwardly, so that the top solid surface 63 is disengaged from the drain opening 50, and liquid flows through the clear openings 66 in the circumferential side wall 64, of the shut-off valve 60, and into the central chamber for dispensing when the lever arm 47 is deflected by hand. This operation by deflection is further illustrated in drawing FIGS. 7 and 8.

Referring again to drawing FIGS. 4-6, the touch operated flow valve 40 also includes a spring member 48 which is capable of biasing against the valve lever member to permit centering and pivotal movement of the valve lever head member 46, within the chamber, between a valve closed and centered position, and a valve open and radially displaced position. These drawing figures illustrate two of the presently preferred embodiments for positioning of the spring member in relation to the valve lever member. In the first embodiment, of FIGS. 4 and 5, the spring member 48 is disposed in the central chamber, and is adapted to annularly compress against the valve head 46. With the second embodiment, of FIG. 6, the spring member 48 is positioned to press fit about the lever arm 47 so that it is capable of making a compressive communication with the inwardly tapering cylindrical opening 44.

As mentioned briefly above, a waste liquid carboy 20 is disposed adjacent to the bottom wall 13 of the compartment, in a spaced relationship below the touch operated flow valves 40. The waste liquid carboy 20 is also preferably constructed as a plastic molded body which formed of transparent Nalgene™, polypropylene, polyethylene, or polycarbonate material(s). The carboy 20 is further dimensioned in a configuration so as to permit a substantially water tight fit against the interior surface of the back 14, side 11, 12, and the lower portion of the front wall 15, of the carrying case 10. In the alternative, but not shown in the drawing figures, the top wall 24 of the carboy 20 may, but need not, further include a peripheral water seal (not shown), such as a plastic or rubber flap or skirt, which biases against the interior surface(s) of the carrying case 10.

The waste liquid carboy 20 has a top wall 24 with a funnel shaped opening so that it is adapted to collect the contaminated rinsate from the hands. The carboy 10 is removable, by lifting, from the interior of the compartment for disposal of the rinsate and cleaning of the carboy 20. The carboy 20 desirably includes a stopper 25, or cap. Where the intended use is in conjunction with normal hand washing applications, the carboy desirably includes a drain opening (not shown) in a bottom wall. However, as mentioned above, the present invention is also designed for use in emergency, or bio-hazardous conditions, where the carboy 20 is simply capped and disposed of with a new carboy retrofit in the interior of the case 10 compartment.

Finally, it is also desirable to further include a towel bar 70, which is pivotally attached to the case 10. The towel bar 70 may, but need not, include a cam actuated bar-end member in pivotal attachment with the carrying case 10 so that, in use, the towel bar 70 biases, compressively downward against an exterior surface of a side wall 11, so that the towel bar 70 secures the towel 71 against pulling, or tearing, with a drying motion by hand.

While the present invention has been described in connection with the preferred and illustrated embodiments, it will be appreciated and is understood that certain modifications may be made to the present invention without departing from the true spirit and scope of the invention.

I claim:

1. A portable hand washing station, comprising:

(a) a durable carrying case including a pair of spaced apart sidewalls connecting a bottom wall, back wall, and front wall, said walls defining an interior hand washing compartment, and whereby the front wall is adapted to include a door capable of opening to permit hand access into the interior of the hand washing compartment;

(b) a lid adapted to be connected to the case, wherein the lid is capable of support on the case in an open vertical position, and wherein the lid further includes a shelf connected to an interior surface of the lid, said shelf having a pair of spaced apart valve openings, wherein the lid is pivotally attached to the sidewalls of the case, a horizontal lip is formed in an upper interior surface of each of the sidewalls, and the shelf further includes a pair of transverse folds defining a pair of oppositely aligned flat spring end members adapted to project downwardly at a first extended angle capable of engaging said lip formations when the lid is pivoted to an open vertical position, and are compressible to a second angle so that the flat spring members are capable of releasing engagement from the lip formations to permit the lid to pivot downwardly into an enclosing position for transport and storage; and (c) a pair of liquid dispensing reservoirs supported on the lid, each of said reservoirs including a top wall including a mouth opening, a bottom wall including a drain opening, and a touch operated flow valve connected to the bottom wall in liquid communication with the drain opening, wherein said flow valves are adapted to extend into the interior hand washing compartment when the flow valves are deflected by hand, wherein said flow valves are capable of extending through the valve openings into the interior of the compartment.

2. The portable hand washing station according to claim 1, further comprising a waste liquid carboy disposed adjacent to the bottom wall of the compartment in a spaced relationship below the touch operated now valves, said waste liquid carboy including a top wall with a funnel shaped opening adapted to collect the rinsate.

3. The portable hand washing station according to claim 1, further comprising a means for attaching a towel to the case.

4. The portable hand washing station according to claim 1, further comprising a handle pivotally connected to the case.

5. The portable hand washing station according to claim 1, wherein the case is a double wall construction.

6. The portable hand washing station according to claim 1, wherein each of the dispensing reservoirs are transparent and the mouth opening of each reservoir is a screw cap assembly.

7. The portable hand washing station according to claim 1 wherein each of the pair of dispensing reservoirs the touch operated flow valves are threadably connected to the drain opening, and each said touch valve further includes an internal plug shut-off member, said shut-off member adapted to cooperate in communication with the drain opening so that a liquid flow from the drain opening shut-off in a closed channel condition, when each of the touch valves are rotated to a tightened position, and the liquid flow is in an open channel flow condition when each of the valves is rotated to a loosened position.

8. The portable hand washing station according to claim 1, wherein the pair of dispensing reservoirs include a cleansing liquid reservoir and a rinsing liquid reservoir, and said reservoirs dimensioned in volume sot that the cleansing liquid reservoir contains a volume in a range of one-third to two-thirds the volume of the rinsing liquid reservoir.

9. The portable hand washing station according to claim 1, wherein the touch operated flow valves include a valve housing formed with a central chamber, a proximal end adapted for connection to the drain opening, a distal end formed with an inwardly tapering cylindrical opening, and an interior wall formed with an annular valve seat, the touch operated flow valve further including a valve lever member, centrally mounted in the chamber, including an annular valve head member and a valve lever arm, wherein the valve head member is adapted to water seal against the valve seat, and the lever arm is dimensioned to extend through the inwardly tapering opening into the interior of the washing compartment so that a flow of water is permitted to pass between the valve lever arm and the inwardly tapering opening when the distal end of the lever arm is deflected by a hand.

10. The portable hand washing station according to claim 1, wherein the interior of the hand washing compartment further includes a reservoir rack having a front, back, and side walls, wherein said back wall is connected to an interior surface of the lid so that the rack is secured on the shelf and is thereby capable of preventing movement of the reservoirs when the hand washing station is subjected to a lateral force.

11. The portable hand washing station according to claim 2, wherein the waste liquid carboy further includes a drain opening and the funnel shaped opening includes a stopper.

12. The portable hand washing station according to claim 3, wherein the attaching means is a towel bar pivotally connected to the case.

13. The portable hand washing station according to claim 9, wherein the touch operated flow valve further comprises a spring member capable of biasing against the valve lever member to permit centering and pivotal movement of the valve lever head member within the chamber between a valves closed centered position and a valve open radially displaced position.

14. The portable hand washing station according to claim 10, wherein the front wall of the rack includes a pair of spaced apart clear slots positioned so that the slots permit viewing of a graduated liquid volume contained in the reservoirs.

15. The portable hand washing station according to claim 13, wherein the spring member is disposed in the central chamber and is adapted to annularly compress against the valve head.

16. The portable hand washing station according to claim 13, wherein the spring member is positioned to press fit about the lever arm in compressive communication with the inwardly tapering cylindrical opening.

17. A portable hand washing station, comprising:

(a) a durable carrying case including a pair of spaced apart sidewalls connecting a bottom wall, back wall, and front wall, said walls defining an interior hand washing compartment, and whereby the front wall is adapted to include a door capable of opening to permit hand access into the interior of the hand washing compartment;

(b) a lid adapted to be connected to the case;

(c) a pair of liquid dispensing reservoirs supported on the lid, each of said reservoirs including a top wall having a mouth opening and a bottom wall including a drain opening; and (d) a touch operated flow valve connected to the bottom wall in liquid communication with the drain opening, each said flow valve including a valve housing formed with a central chamber, a proximal end adapted for connection to the drain opening, a distal end formed with an inwardly tapering cylindrical opening forming a portion of a frustroconical shape that is a symmetrically continuous opening, and an interior wall formed with an annular valve seat protrusion shaped as an annular continuous raised ridge, the touch operated flow valve including a valve lever member, centrally mounted in the chamber, including an annular valve head member and a valve lever arm, wherein the valve head member is adapted to water seal against the valve seat, and the lever arm is dimensioned to extend through the inwardly tapering opening into the interior of the washing compartment, so that a flow of water is permitted to pass between the valve lever arm and the inwardly tapering opening when the distal end of the lever arm is deflected by hand in an omnidirectional manner.

18. The portable hand washing station according to claim 17, wherein each said flow valve annular continuous raised ridge peripherally circumferentially nests an o-ring, forming said water seal as between said valve head and said valve seat, wherein operationally when said lever arm is laterally deflected by hand in an omnidirectional manner said annular valve head has a pivotal fulcrum upon a furthermost extension of said annular continuous raised ridge such that said o-ring is freely uncompressed forming a peripheral continuous flow annular flow gap for water flow as between said o-ring and said annular valve head.

* * * * *